US011001405B2

(12) United States Patent
Enoki et al.

(10) Patent No.: US 11,001,405 B2
(45) Date of Patent: May 11, 2021

(54) THREADED BOTTLE-SHAPED CAN AND MANUFACTURING METHOD THEREOF

(71) Applicant: DAIWA CAN COMPANY, Chiyoda-ku (JP)

(72) Inventors: Yasushi Enoki, Sagamihara (JP); Osamu Yoshida, Sagamihara (JP)

(73) Assignee: DAIWA CAN COMPANY, Chiyoda-ku (JP)

( * ) Notice: Subject to any disclaimer, the term of this patent is extended or adjusted under 35 U.S.C. 154(b) by 93 days.

(21) Appl. No.: 16/298,734

(22) Filed: Mar. 11, 2019

(65) Prior Publication Data

US 2019/0291913 A1 Sep. 26, 2019

(30) Foreign Application Priority Data

Mar. 12, 2018 (JP) ..... JP2018-044312

(51) Int. Cl.
*B65D 1/02* (2006.01)
*B21D 51/26* (2006.01)

(52) U.S. Cl.
CPC ..... *B65D 1/0246* (2013.01); *B21D 51/2623* (2013.01); *B21D 51/2669* (2013.01); *B65D 1/0207* (2013.01)

(58) Field of Classification Search
CPC .... B65D 1/0246; B65D 2/07; B21D 51/2653; B21D 51/2669; B21D 51/2623; B21D 51/42; B21D 51/40; B21D 51/50
USPC ..... 215/44
See application file for complete search history.

(56) References Cited

U.S. PATENT DOCUMENTS 4,353,475 A * 10/1982 Kachur ..... B65D 50/046 215/217
5,293,765 A 3/1994 Nussbaum-Pogacnik
6,463,776 B1 10/2002 Enoki et al.
6,499,329 B1 12/2002 Enoki et al.
8,286,460 B2 * 10/2012 Frattini ..... B21D 19/12 72/379.4
10,040,608 B2 * 8/2018 Olson ..... B65D 41/125
2009/0035096 A1 * 2/2009 Enoki ..... B65D 51/1688 413/6
2014/0008320 A1 * 1/2014 Hosoi ..... B21H 3/02 215/252

(Continued)

FOREIGN PATENT DOCUMENTS

JP 3375661 B2 2/2003
JP 5855233 B2 2/2016

(Continued)

*Primary Examiner* — Anthony D Stashick
*Assistant Examiner* — Raven Collins
(74) *Attorney, Agent, or Firm* — Oblon, McClelland, Maier & Neustadt, L.L.P.

(57) ABSTRACT

A bottle-shaped can in which flatness and circularity of a neck portion are improved. An upper incomplete thread portion is formed at an upper end of a thread. A height of the upper incomplete thread portion is shorter than an average height of the thread, and increases gradually toward the average height. A length of the upper incomplete thread portion between a first point and a second point is set in such a manner that an angle between a line drawn between the first point and a center point of the neck portion, and a line drawn between the second point and the center point of the neck portion falls within a range from 20 degrees to 60 degrees.

5 Claims, 18 Drawing Sheets

(56) References Cited

U.S. PATENT DOCUMENTS

2015/0013416 A1 1/2015 Hosoi

FOREIGN PATENT DOCUMENTS

| | | | |
|---|---|---|---|
| JP | 6067090 | B2 | 1/2017 |
| WO | WO 01/15829 | A1 | 3/2001 |
| WO | WO 01/23117 | A1 | 4/2001 |

* cited by examiner

At Initial Phase of Threading

After Rotating 360°

After Threading

After 4th Curling

After Bead Forming

Fig. 16

| | | 1st Sample | 2nd Sample | 3rd Sample | 1st Comparison Sample | Reference Can |
|---|---|---|---|---|---|---|
| | (Target Value) | 60° | 40° | 20° | 10° | |
| Circurality of Outer Diamater of Curled Portion (mm) (max-min) | (Less than 0.15) | 0.1 | 0.12 | 0.14 | 0.16 | 0.04 |
| Flatness of Curled Portion (mm) (max-min) | (Less than 0.1) | 0.07 | 0.07 | 0.08 | 0.12 | 0.02 |
| Result | | Acceptable | Acceptable | Acceptable | Unacceptable | |

Fig. 17

| | | 4th Sample | 5th Sample | 6th Sample | 2nd Comparison Sample | Reference Can |
|---|---|---|---|---|---|---|
| (Target Value) | | 40° | 20° | 10° | 5° | |
| Circurality of Outer Diameter of Stepped Portion (mm) (max-min) | (Less than 0.15) | 0.09 | 0.09 | 0.12 | 0.17 | 0.03 |
| Flatness of Stepped Portion (mm) (max-min) | (Less than 0.1) | 0.07 | 0.07 | 0.07 | 0.08 | 0.02 |
| Result | | Acceptable | Acceptable | Acceptable | Unacceptable | |

THREADED BOTTLE-SHAPED CAN AND MANUFACTURING METHOD THEREOF

The present invention claims the benefit of Japanese Patent Application No. 2018-044312 filed on Mar. 12, 2018 with the Japanese Patent Office, the disclosure of which is incorporated herein by reference in its entirety.

BACKGROUND

Field of the Invention

The present disclosure relates to an art of a bottle-shaped can in which a thread is formed on a neck portion on which a closure is mounted, and a manufacturing method thereof.

Discussion of the Related Art

The bottle-shaped can of this kind is shaped into a bottle-shape by drawing and ironing a metallic material such as an aluminum material. The bottle-shaped can thus formed comprises a trunk portion as a main body in which a diameter thereof is relatively large, a shoulder portion in which the diameter is reduced gradually toward an upper portion, and a neck portion which is formed on an upper end of the shoulder portion and in which the diameter is smaller than that of the shoulder portion. An opening of the neck portion is closed by a cap or a closure.

Methods for manufacturing the bottle-shaped can are described in PCT international publications Nos. WO 01/15829 A1 and WO 01/23117 A1. According to the teachings of WO 01/15829 A1 and WO 01/23117 A1, first of all, a metallic sheet is drawn into a cup-shaped interim product, and the cup-shaped interim product is shaped into a cylindrical body having a bottom portion by drawing and ironing. A corner portion between the bottom portion and the trunk portion is shaped into a domed-shape or a tapered-shape to form a shoulder portion and a diametrically-smaller cylindrical portion as a neck portion. A leading end of the neck portion is cut out (or trimmed) to form an opening. Thereafter, an opening end of the neck portion is curled, and a thread is formed on the neck portion. The thread may be formed on the neck portion by various methods, and one example of which is described in JP-B-3375661. According to the teachings of JP-B-3375661, a container material in which the neck portion is formed is fixed, and an inner screw pitch gauge is inserted into the neck portion. Then, the neck portion is sandwiched by the inner screw pitch gauge and an outer thread roll, and the inner screw pitch gauge and the outer screw roll are rotated around the neck portion to form the thread on the neck portion.

As described in the above-mentioned prior art documents, the thread as a helical ridge is formed on the neck portion by pressing the neck portion inwardly and outwardly. A cylindrical raw material of the cap is applied to the neck portion on which the thread is formed, and a thread groove is formed on a cylindrical portion (i.e., a skirt portion) of the cap along a thread ridge formed on the neck portion of the cap. During such process, a circumferential corner of a top panel of the cap is drawn to bring a resin sealing liner affixed to an inner face of the top panel into close contact to a curled portion formed on an opening end of the neck portion. A pilfer-proof band is joined to a lower end of the skirt portion through bridges, and the pilfer-proof band is drawn to wrap onto an annular bead formed below the thread. When the cap is twisted counterclockwise, the cap is dismounted from the neck portion by the action of the thread ridge and the thread groove. Consequently, the bridges are broken so that the pilfer-proof band is detached from the skirt portion. The cap may be mounted on the neck portion again by twisting the cap clockwise on the neck portion.

In order to reseal the can by the cap, it is preferable to smoothly engage an end portion of the thread ridge formed on the neck portion of the can with an end portion of the thread groove formed on the skirt portion of the cap so as to allow the cap to rotate smoothly. For example, JP-B-5855233 and JP-B-6067090 describe methods for forming the threads in such a manner as to engage the threads smoothly with each other. Specifically, JP-B-5855233 and JP-B-6067090 describe methods for reducing deformation of the threads due to buckling or the like after forming the threads. According to the teachings of JP-B-5855233 and JP-B-6067090, a tapered part is formed below the curled portion formed on an upper end of the neck portion so that a diameter is increased gradually from the curled portion, and the thread is formed in such a manner as to situate an incomplete-thread part of a starting end of the thread at an intermediate part of the tapered part.

As described, the thread ridge or the thread groove is formed by pushing the neck portion of the can inwardly or outwardly in a helical manner. Therefore, the thread accuracy may be reduced due to buckling or the like. According to the teachings of JP-B-5855233 and JP-B-6067090, the thread groove is allowed to engage easily and certainly by situating a starting end of the thread groove within the tapered part to restrict a height of the thread groove.

However, when forming the thread on the neck portion of the bottle-shaped can, not only the forming accuracy of the thread itself but also the forming accuracy of the neck portion are required. In particular, it is required to lessen an impact to open the leading end of the neck portion on the accuracy of the neck portion as much as possible. As described, the thread is formed by deforming the neck portion inwardly or outwardly, therefore, the material of the neck portion is displaced in a circumferential direction and an axial direction during the forming process of the thread. If a portion having an excess thickness exists in the vicinity of a portion to be processed, the material is allowed to move from such portion having an excess thickness so that the neck portion is formed more accurately. However, in a portion without having such an excess thickness, the material is moved from the vicinity during the forming process of the thread, and as a result, the portion without having an excess thickness and in the vicinity thereof may be deformed. None of the above-explained prior art documents discuss about such deformation and dimensional variation of the neck portion due to drawing or movement of the material. Therefore, a torque to rotate the cap may not be stabilized, and sealing ability of the cap may be reduced.

SUMMARY OF THE INVENTION

The present disclosure has been conceived nothing the foregoing technical problems, and it is therefore an object of the present disclosure to provide a threaded bottle-shaped can in which a torque to rotate a cap is stabilized and a sealing ability of the cap is enhanced, and a manufacturing method thereof.

According to at least one aspect of the present disclosure, there is provided a metallic threaded bottle-shaped can, comprising: a cylindrical trunk portion; a shoulder portion that is formed continuously upwardly from an upper end of the trunk portion in such a manner that an outer diameter is gradually reduced toward an upper side; a cylindrical neck portion having an opening on an upper end, that is formed continuously upwardly from an upper central end of the shoulder portion; and a thread as a helical ridge that is formed around the neck portion. In the bottle-shaped can, the thread includes an upper incomplete thread portion that is formed at an upper end of the thread. A height of the ridge of the upper incomplete thread portion is shorter than an average value of the entire thread, and increases gradually toward the average value. In order to achieve the above-explained objective, according to the exemplary embodiment of the present disclosure, a length of the upper incomplete thread portion in a circumferential direction of the neck portion between: a first point at which a height of the ridge is one-half of the average height; and a second point at which a height of the ridge is one-quarter of the average height, is set in such a manner that an angle between a line drawn between the first point and a center point of the neck portion, and a line drawn between the second point and the center point of the neck portion falls within a range from 20 degrees to 60 degrees.

In a non-limiting embodiment, the thread may include a lower incomplete thread portion that is formed at a lower end of the thread. A height of the ridge of the lower incomplete thread portion may be shorter than the average value of the entire thread, and may decrease gradually from the average value. A length of the lower incomplete thread portion in the circumferential direction of the neck portion between: a third point at which a height of the ridge is one-half of the average height; and a fourth point at which a height of the ridge is one-quarter of the average height, may be set in such a manner that an angle between a line drawn between the third point and the center point of the neck portion, and a line drawn between the fourth point and the center point of the neck portion falls within a range from 10 degrees to 40 degrees.

In a non-limiting embodiment, more than 1.9 laps but less than 2.1 laps of an effective thread portion in which a height of the ridge is the average height may be formed between the upper incomplete thread portion and the lower incomplete thread portion. A distance between the second point and the fourth point may be set in such a manner that an angle between the line drawn between the second point and the center point of the neck portion, and the line drawn between the fourth point and the center point of the neck portion falls within a range from 60 degrees to 130 degrees.

In a non-limiting embodiment, the neck portion may comprise a first cylindrical portion on which the thread is formed, and a diametrically shrinking curved portion formed between an upper end of the first cylindrical portion and a tapered portion in which an outer diameter decreases gradually upwardly. An effective thread portion in which a height of the ridge is the average height may be formed on the first cylindrical portion, and the upper incomplete thread portion may be formed on the diametrically shrinking curved portion.

In a non-limiting embodiment, the neck portion may comprise a second cylindrical portion formed continuously from an upper end of the shoulder portion, a diametrically shrinking portion formed continuously from the second cylindrical portion in which a diameter thereof is reduced gradually toward the upper side, and a first cylindrical portion formed continuously from an upper end of the diametrically shrinking portion on which the thread is formed. An effective thread portion in which a height of the ridge is the average height may be formed on the first cylindrical portion, and the lower incomplete thread portion may be formed on the diametrically shrinking portion.

According to another aspect of the present disclosure, there is provided a method for manufacturing the above-mentioned metallic threaded bottle-shaped can, comprising: a plurality of curling steps of curling an upper end of the opening of the neck portion outwardly; a threading step of forming the helical thread ridge around the neck portion during execution of the curling steps; adjusting flatness of an upper edge of a curled portion formed on the neck portion less than 0.1 after the completion of the curling steps; and thereafter forming an annular emboss bead on the neck portion below the thread by expanding the neck portion radially outwardly, in such a manner that a circularity as a difference in a radius of the neck portion measured all around the neck portion is reduced less than 0.15.

Thus, in the bottle-shaped can according to the exemplary embodiment of the present disclosure, the thread as a helical ridge is formed on the neck portion. The thread includes the effective thread portion in which a height of the ridge is the average height, and the upper incomplete thread portion and the lower incomplete thread portion formed at both circumferential ends of the effective thread portion. As a result of forming the thread, the metallic material is drawn from the vicinity of the thread. According to the exemplary embodiment of the present disclosure, a length of the upper incomplete thread portion in a circumferential direction of the neck portion is set in such a manner that the above-mentioned angle falls within a range from 20 degrees to 60 degrees. That is, the upper incomplete thread portion formed only at a specific portion of the neck portion has a relatively long length in the circumferential direction. According to the exemplary embodiment of the present disclosure, therefore, the metallic material may be drawn from a broad region when forming the upper incomplete thread portion. In other words, the metallic material will not be drawn locally from a small region. For this reason, distortion and deformation in the vicinity of the thread can be reduced even if the metallic material is drawn when forming the thread. Especially, a flatness of the upper edge of the neck portion may be improved. In addition, a circularity of the neck portion may also be improved even if it is deformed into an oval shape.

In the bottle-shaped can according to the exemplary embodiment of the present disclosure, a length of the lower incomplete thread portion in the circumferential direction is also relatively long. According to the exemplary embodiment of the present disclosure, therefore, the metallic material will not be drawn locally from a small region also in a case of forming the lower incomplete thread portion. For this reason, local deformation in the vicinity of the lower incomplete thread portion, especially, an oval deformation of the neck portion may be reduced. In other words, the circularity of the neck portion may be improved. In addition, since the metallic material can be drawn from a broad region also in the axial direction, the flatness of the upper edge of the neck portion may also be improved.

In the bottle-shaped can according to the exemplary embodiment of the present disclosure, substantially two laps of the effective thread portion is formed on the neck portion. The metallic material is also drawn when forming the effective thread portion. However, according to the exemplary embodiment of the present disclosure, the number of laps of the effective thread portion is integer. According to the exemplary embodiment of the present disclosure, therefore, the metallic material may be drawn homogeneously from the vicinity of the effective thread portion entirely around the neck portion. On the other hand, the upper incomplete thread portion and the lower incomplete thread portion are formed at specific portion in the circumferential direction of the neck portion. That is, a counter portion to compensate the deformation resulting from drawing of the metallic material does not exist in the vicinity of the upper incomplete thread portion and the lower incomplete thread portion. For this reason, distortion resulting from unevenness of deformation slightly remains in the neck portion. Especially, the upper incomplete thread portion is formed on the neck portion at a portion closest to the upper edge. If the threading is completed but a height of the ridge is too high, the flatness of the upper edge of the neck portion may be reduced due to withdrawal of the metallic material from a local region. In addition, the neck portion may be distorted thereby reducing the circularity. In order to avoid such disadvantages, according to the exemplary embodiment of the present disclosure, lengths of the upper incomplete thread portion and the lower incomplete thread portion are relatively long, and the upper incomplete thread portion and the lower incomplete thread portion are isolated away from each other in the circumferential direction. For this reason, the flatness and circularity of the upper edge of the neck portion can be ensured. In addition, the lower incomplete thread portion will not interfere with an annular bead that is formed below the thread to be engaged with a pilfer-proof band.

In the bottle-shaped can according to the exemplary embodiment of the present disclosure, the effective thread portion is formed on the first cylindrical portion, and the upper incomplete thread portion is formed on the diametrically shrinking curved portion formed above the first cylindrical portion. The diametrically shrinking curved portion is curved in both circumferential and axial directions so as to enhance rigidity thereof. According to the exemplary embodiment of the present disclosure, therefore, the deformation of the neck portion may be reduced by forming the upper incomplete thread portion on the diametrically shrinking curved portion in which the rigidity is thus enhanced. In addition, since an outer diameter of the diametrically shrinking curved portion is smaller than an outer diameter of the effective thread portion, the thread ridge formed on the neck portion may be engaged smoothly with a thread groove formed on a cap when the cap is mounted on the neck portion again to reseal the bottle-shaped can.

Further, in the bottle-shaped can according to the exemplary embodiment of the present disclosure, the lower incomplete thread portion is formed on the diametrically shrinking portion extending below the first cylindrical portion. Since the diametrically shrinking portion is curved in both circumferential and axial directions, the rigidity of the diametrically shrinking portion is enhanced. According to the exemplary embodiment of the present disclosure, therefore, deformation of the neck portion may be reduced by forming the lower incomplete thread portion on the diametrically shrinking portion.

According to the manufacturing method of the exemplary embodiment, the final curling step and the bead forming step are executed after the threading step. According to the manufacturing method of the exemplary embodiment, therefore, the flatness and circularity of the upper edge of the neck portion on which the thread is formed may be improved. Specifically, the flatness is improved to be less than 0.1 mm, and the circularity is improved less than 0.15 mm. For this reason, an opening torque to dismount the cap from the neck portion or a re-capping torque to mount the cap onto the neck portion will not be increased excessively. In addition, sealing ability of the cap may be improved.

BRIEF DESCRIPTION OF THE DRAWINGS

Features, aspects, and advantages of exemplary embodiments of the present invention will become better understood with reference to the following description and accompanying drawings, which should not limit the invention in any way.

FIGS. 9A and 9B are partial views in which FIG. 9A shows a situation of the neck portion when starting the threading step, and FIG. 9B shows a situation of the neck portion when the inner tool revolves around the neck portion;

FIG. 16 is a table showing measured flatness and circularity of the curled portion in each of the sample cans and the reference can;

FIG. 17 is a table showing measured flatness and circularity of the stepped portion in each of the sample cans and the reference can.

DETAILED DESCRIPTION OF THE PREFERRED EMBODIMENT(S)

Figure 1:
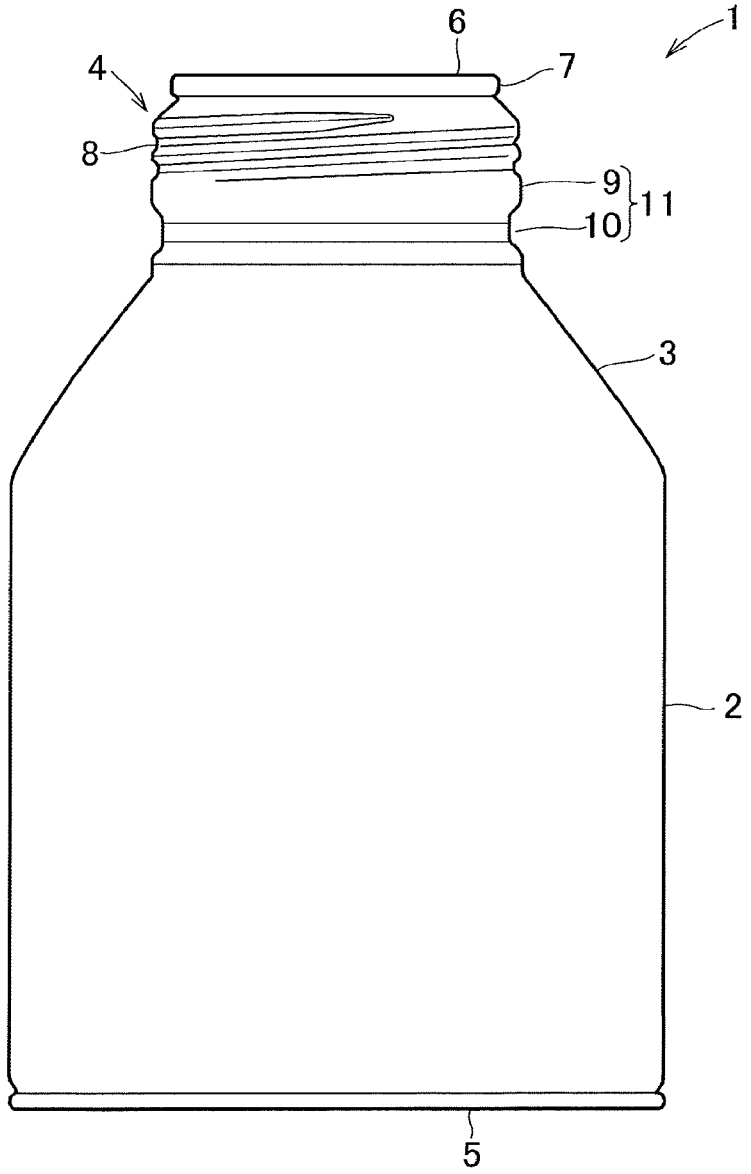
FIG. 1 is a front view of the bottle-shaped can to which the present disclosure is applied.

Hereinafter, an exemplary embodiment of the present disclosure will be explained in more detail with reference to the accompanying drawings. Turning now to FIG. 1, there is shown a bottle-shaped can 1 formed of a metallic sheet such as an aluminum sheet or a resin-coated aluminum sheet. The bottle-shaped can 1 comprises a diametrically-larger cylindrical trunk portion 2, a shoulder portion 3 formed continuously from the trunk portion 2 whose diameter is reduced gradually, and a diametrically smaller cylindrical neck portion 4 formed continuously from the shoulder portion 3. The neck portion 4 has an opening 6 on its leading end portion. In order to use the opening 6 of the neck portion 4 as a container mouth, a curled portion 7 having a round or an oval cross-section is formed on the opening 6 by folding or rolling an opening edge of the neck portion 4 outwardly into two or three layers. The opening 6 is closed by a resealable cap (not shown) mounted on the neck portion 4. A bottom lid 5 is seamed to a bottom of the bottle-shaped can 1.

Specifically, a thread 8 as a thread ridge is formed on the neck portion 4, and the closure is mounted on the neck portion 4 through the thread 8. Although not especially illustrated in FIG. 1, horizontal slits and bridges are formed alternately in a circumferential direction on a lower portion of a skirt of the cap so that a pilfer-proof band is formed on a lower end of the skirt of the cap. An annular emboss bead 9 is formed below the thread 8, and an annular groove 10 is formed below the emboss bead 9. In the following explanation, the emboss bead 9 and the annular groove 10 will also be called the stepped portion 11. When the closure mounted on the neck portion 4 is twisted, the pilfer proof band is engaged with the emboss bead 9 so that the bridges are ruptured and the pilfer-proof band is detached from the lower end portion of the skirt of the closure. The pilfer-proof band thus detached from the skirt of the closure is retained in the annular groove 10.

Figure 2:
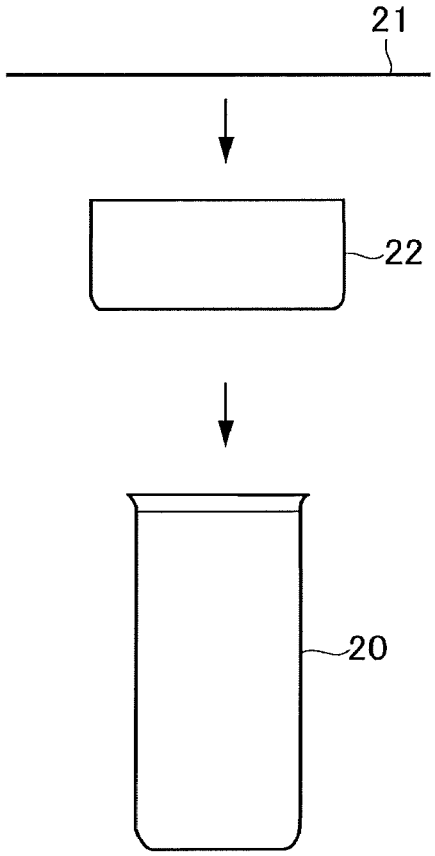
FIG. 2 is a schematic illustration showing a process of forming a trunk portion of the bottle-shaped can.
Figure 3:
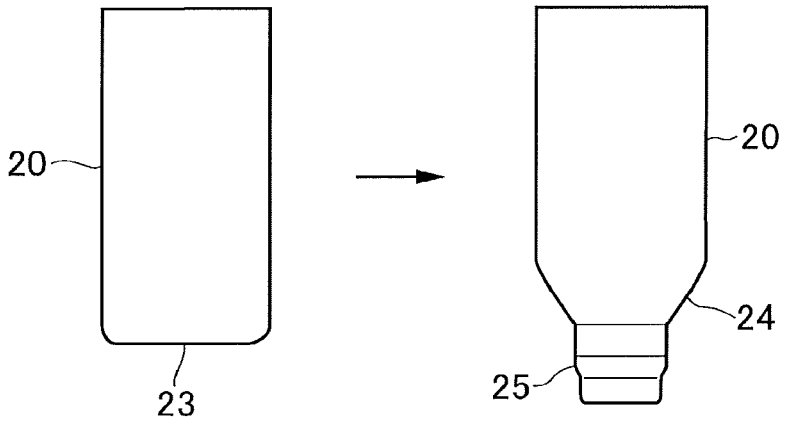
FIG. 3 is a schematic illustration showing a process of forming a shoulder portion and a diametrically-smaller cylindrical portion of the bottle-shaped can.

Here will be explained a manufacturing process of the bottle-shaped can 1. Turning to FIG. 2, there is shown a forming process of a can trunk 20. First of all, a blank 21 is punched out of a thin metallic sheet material, and the blank 21 is drawn into a shallow cup-shaped interim product 22. Thereafter, the interim product 22 is shaped into the can trunk 20 corresponding to the aforementioned trunk portion 2 by further applying a drawing and ironing to the interim product 22. In this phase, as illustrated in FIG. 3, the can trunk 20 has a bottom 23. A center portion of the bottom 23 is drawn and ironed to be gradually stretched while reducing a diameter of a circumferential corner of the bottom 23. As a result, a shoulder portion 24 and a diametrically-smaller cylindrical portion 25 are formed on a bottom side of the can trunk 20.

Figure 4:
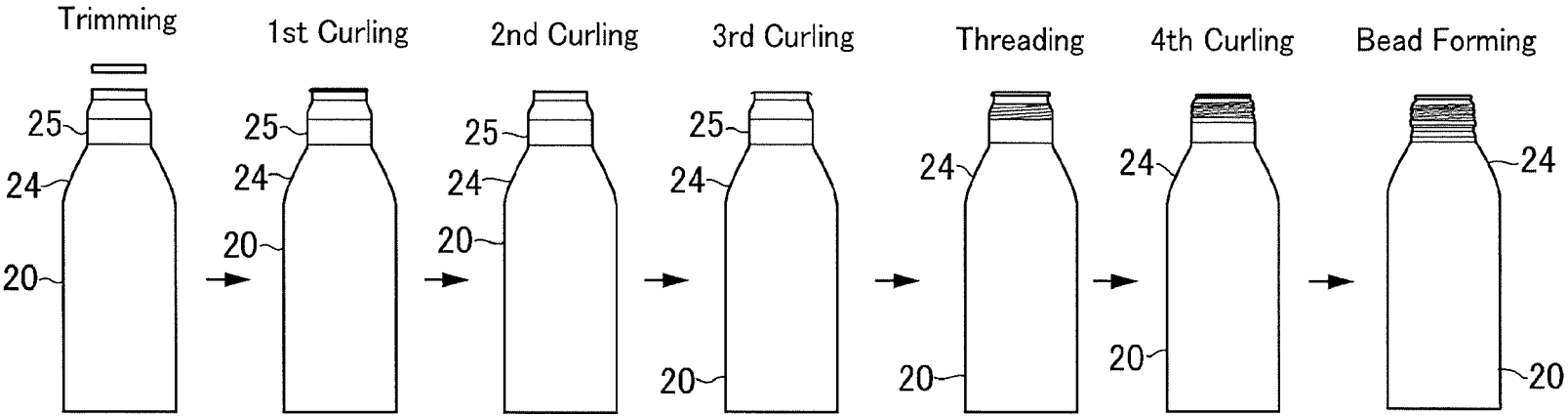
FIG. 4 is a process chart showing trimming, curling, threading and bead forming steps.

The diametrically-smaller cylindrical portion 25 is to be shaped into the neck portion 4, and for this purpose, the diametrically-smaller cylindrical portion 25 is further processed to have a capping function and a tamper-evidence function. A forming process of the neck portion 4 is shown in FIG. 4 in more detail. First of all, in order to form a container mouth on a leading end of the diametrically-smaller cylindrical portion 25, the leading end is cut out at a trimming step to be opened. In order to confine a sharp opening edge inside of the curled portion 7 having a round cross-section, the opening edge of the diametrically-smaller cylindrical portion 25 is folded 4 outwardly into e.g., three layers. According to the example shown in FIG. 4, the curled portion 7 is formed by four curling steps. At the first curling step, the opening edge of the diametrically-smaller cylindrical portion 25 is bent outwardly to form a flange, and at the second curling step, the flange is further bent downwardly so that a folded portion of two layers is formed on the leading end of the diametrically-smaller cylindrical portion 25. Then, at the third curling step, the two-layered folded portion is bent outwardly so as to form a flange of two layers. Thereafter, at the fourth curling step, the two-layered flange thus formed is curled downwardly outwardly so that the opening edge of the diametrically-smaller cylindrical portion 25 is confined in the curled portion 7.

During the process of forming the curled portion 7, the thread 8 is formed on the neck portion 4, and the emboss bead 9 is formed after the threading (e.g., after the final step of the curling) step to provide the tamper evidence function to the bottle-shaped can 1. In other words, the curling process is completed after the threading step, and then the bead forming step is executed.

Figure 5:
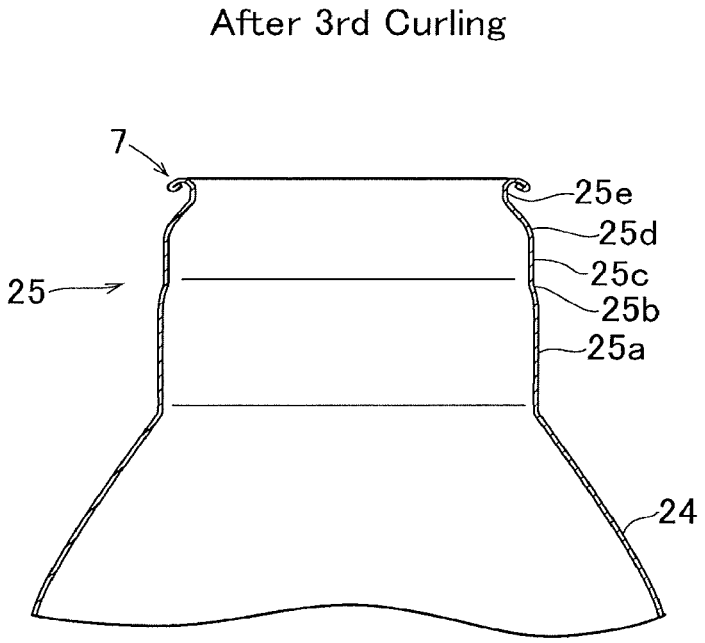
FIG. 5 is a partial cross-sectional view showing the diametrically-smaller cylindrical portion after the third curling step.

A shape of the diametrically-smaller cylindrical portion 25 immediately before the threading step, that is, after the third curling step is shown in FIG. 5. A cylindrical neck portion 25*a* as a second cylindrical portion extends continuously upwardly from the shoulder portion 3, and a diameter of the cylindrical neck portion 25*a* is largest in the diametrically-smaller cylindrical portion 25. A cylindrical threaded portion 25*c* as a first cylindrical portion is formed above the cylindrical neck portion 25*a* via a diametrically shrinking portion 25*b* in which a diameter thereof is reduced gradually. The thread 8 as a helical thread ridge is formed on the cylindrical threaded portion 25*c*. A diameter of the cylindrical threaded portion 25*c* is slightly smaller than the diameter of the cylindrical neck portion 25*a*, and a length of the cylindrical threaded portion 25*c* in an axial direction is long enough to form an effective thread portion of the thread 8. A diametrically shrinking curved portion 25*d* extends continuously upwardly from the cylindrical threaded portion 25*c*. That is, the diametrically shrinking curved portion 25*d* is a boundary between the cylindrical threaded portion 25*c* and a tapered portion formed below a curled cylindrical portion 25*e* that is diametrically smaller than the cylindrical threaded portion 25*c*. Specifically, the diametrically shrinking curved portion 25*d* is curved smoothly also in a vertical direction to eliminate a stepped portion in the tapered portion. The curled cylindrical portion 25*e* is a cylindrical portion situated diametrically inner side of the curled portion 7, and a diameter of the curled cylindrical portion 25*e* corresponds to an opening diameter of the bottle-shaped can 1.

Figure 7:
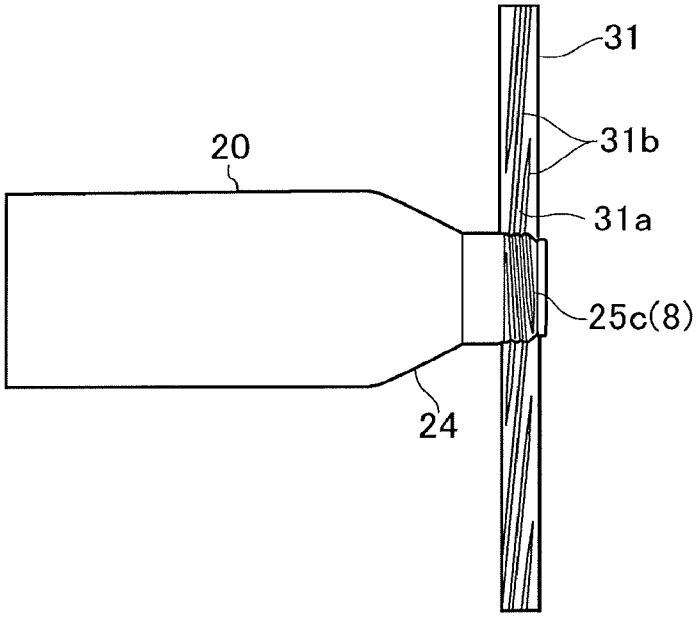
FIG. 7 is a schematic illustration showing one example of a forming surface of the outer tool.
Figure 8:
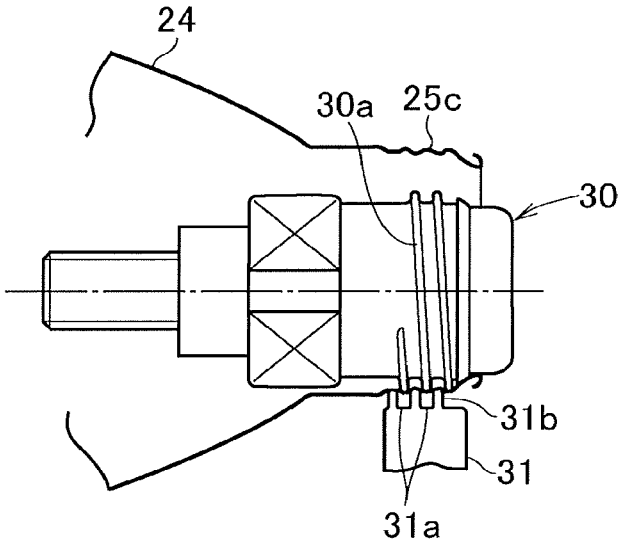
FIG. 8 is a schematic illustration showing one example of the inner tool.

Next, the threading step will be explained with reference to FIGS. 6 to 8. The thread 8 is formed on the cylindrical threaded portion 25*c* using an inner tool 30 that is inserted loosely into the neck portion 4 in a rotatable and revolvable manner, and an outer tool 31 that is disposed on outside of the neck portion 4 along a revolution orbit of the inner tool 30. That is, the thread 8 as a helical ridge is formed on the cylindrical threaded portion 25*c* by sandwiching the cylindrical threaded portion 25*c* between the inner tool 30 and the outer tool 31. An outer diameter of the inner tool 30 as a cylindrical tool is smaller than an inner diameter of the cylindrical threaded portion 25*c* so that the inner tool 30 is allowed to be inserted into the cylindrical threaded portion 25*c*. In order to form the thread 8 on the cylindrical threaded portion 25*c*, a helical ridge 30*a* is formed on an outer circumferential surface of the inner tool 30. On the other hand, the outer tool 31 comprises an arcuate forming surface extending along the revolution orbit of the inner tool 30, and a plurality of inclined grooves 31*a* are formed on the forming surface to be engaged with the helical ridge 30*a* of the inner tool 30. In other words, a thread groove of the thread 8 is formed by inclined linear ridges 31*b* formed on the forming surface of the outer tool 31 alternately with the inclined grooves 31*a*. Specifically, the helical ridge 30*a* and the inclined linear ridges 31*b* are respectively shaped in such a manner as to form an effective thread portion of the thread 8 and incomplete thread portions at both end portions of the effective thread portion. To this end, a height and a width (or thickness) of each of the helical ridge 30*a* and the inclined linear ridges 31*b* changes gradually.

Figure 6:
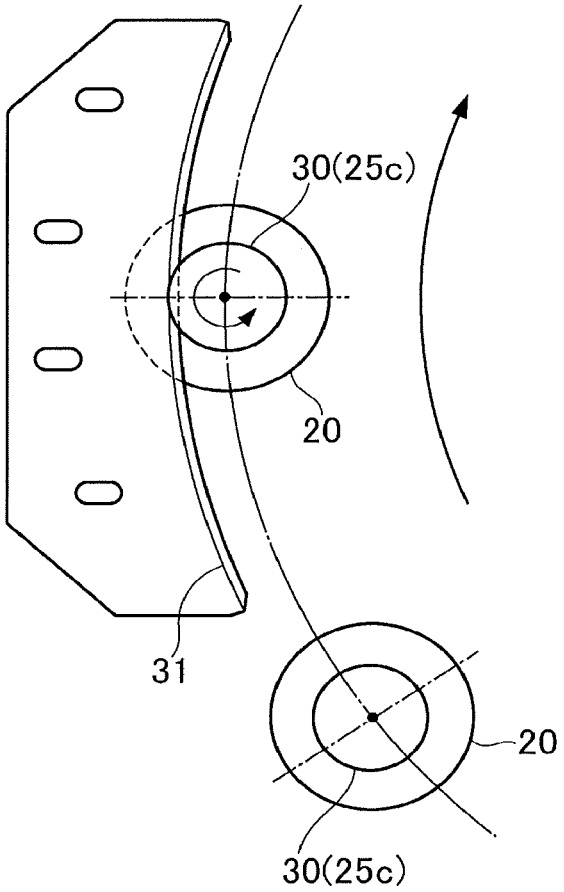
FIG. 6 is a schematic illustration showing a relative position between an outer tool and a revolution orbit of an inner tool.

The inner tool 30 inserted into the cylindrical threaded portion 25*c* revolves in the direction indicated by the arrow in FIG. 6. When the inner tool 30 reaches the outer tool 31 fixed in the outer circumferential side of the revolution orbit of the inner tool 30, the cylindrical threaded portion 25*c* is wedged between the inner tool 30 and the outer tool 31. Consequently, the helical ridge 30*a* of the inner tool 30 is engaged with the inclined grooves 31*a* of the outer tool 31 so that the cylindrical threaded portion 25*c* is deformed radially inwardly and outwardly. In this situation, the cylindrical threaded portion 25*c* to which the inner tool 30 is inserted further revolves in the direction indicated by the arrow in FIG. 6 while rotating. As a result, the thread 8 in which the thread ridge and the thread groove are formed alternately in a helical manner is formed entirely around the cylindrical threaded portion 25*c*.

Figure 9A:
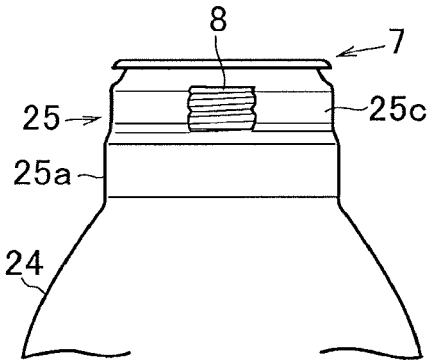
Figure 9B:
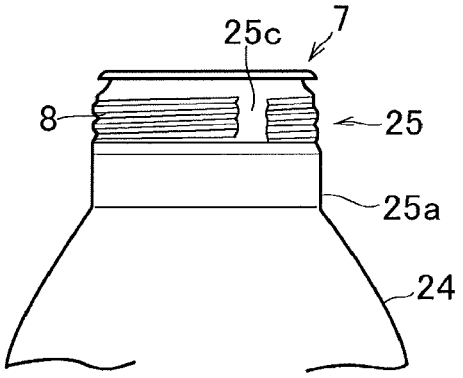

Specifically, the helical ridge 30*a* consisting of plurality of helices is formed on the inner tool 30, and a plurality of the inclined grooves 31*a* are formed on the outer tool 31 to be engaged with the helical ridge 30*a* of the inner tool 30. As illustrated in FIG. 9A, when the inner tool 30 starts engaging with the outer tool 31, a plurality of thread ridges are formed on the cylindrical threaded portion 25*c* over a predetermined circumferential range. Then, when the inner tool 30 is rotated 360 degrees, the thread ridges are formed on major part of the cylindrical threaded portion 25*c* as illustrated in FIG. 9B. As described, the outer diameter of the inner tool 30 is smaller than the inner diameter of the cylindrical threaded portion 25*c*. That is, an outer circumferential length of the inner tool 30 is shorter than an inner circumferential length of the cylindrical threaded portion 25*c*. Therefore, the thread ridge cannot be formed entirely around the cylindrical threaded portion 25*c* by merely rotating the inner tool 30 360 degrees, and an unthreaded portion remains on the cylindrical threaded portion 25*c*. For this reason, the thread 8 is formed on the cylindrical threaded portion 25*c* by rotating the inner tool 30 more than 360 degrees (e.g., more than 396 degrees). Consequently, at least a portion of the thread 8 is threaded again by the inner tool 30 and the outer tool 31. That is, if such portion to be threaded again is initially deformed due to spring back or the like, such deformed portion of the thread 8 may be shaped into a desired shape by the repetition of threading. Thus, the thread 8 can be formed finely by thus rotating the inner tool 30 more than 396 degrees.

Figure 10A:
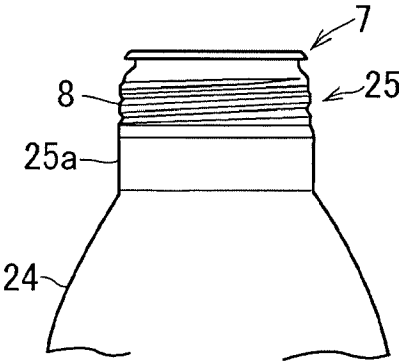
FIG. 10A shows the diametrically-smaller cylindrical portion after the threading step.

A shape of the diametrically smaller cylindrical portion 25 at the completion of the threading step is shown in FIG. 10A.

Figure 10B:
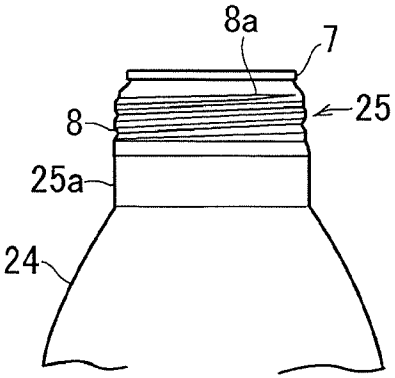
FIG. 10B shows the diametrically-smaller cylindrical portion after the curling step.

After the completion of the threading step, the fourth curling step is executed. As described, at the fourth curling step, the two-layered flange formed at the third curling step is further curled downwardly outwardly. As a result, a hemmed or hollow curled portion 7 of three layers is formed on the opening 6 of the neck portion 4. At the fourth curling step, a forming tool (not shown) is also pushed onto an end portion of the flange from above and from the outer circumferential side so that an upper surface (i.e., an upper edge) of the curled portion 7 is flattened by a forming surface of the forming tool. Consequently, the curled portion 7 is shaped into a substantially true circular shape. A shape of the diametrically smaller cylindrical portion 25 at the completion of the fourth curling step is shown in FIG. 10B.

Figure 10C:
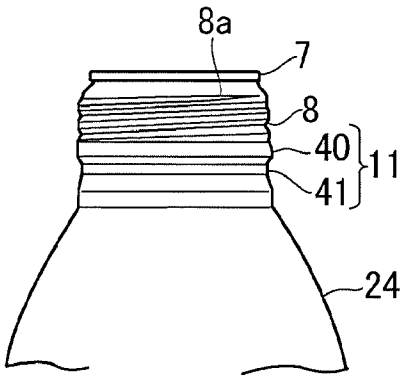
FIG. 10C shows the diametrically-smaller cylindrical portion after the bead forming step.
Figure 11:
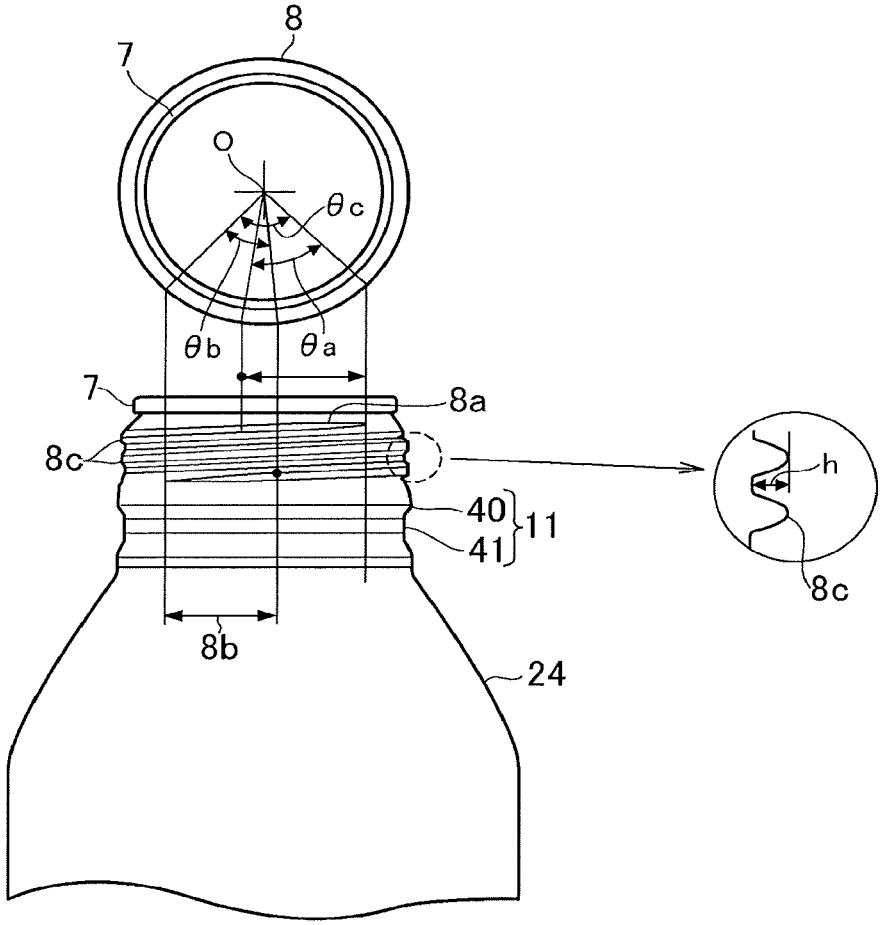
FIG. 11 is a front view and a top view showing the neck portion.

After the curling steps, the bead forming step is executed. At the bead forming step, an annular bead 40 is formed entirely around the cylindrical neck portion 25*a* extending below the cylindrical threaded portion 25*c* via the diametrically shrinking portion 25*b*. For example, the annular bead 40 may be formed by a predetermined inner tool inserted into the cylindrical neck portion 25*a* and an outer tool fixed in the outer circumferential side of the revolution orbit of the inner tool. Instead, the annular bead 40 may also be formed by sandwiching the cylindrical neck portion 25*a* by an inner roll inserted into the cylindrical neck portion 25*a* and an outer roll situated in the outer circumferential side of the cylindrical neck portion 25*a*. A shape of the annular bead 40 is shown in FIGS. 10C and 11. A main function of the annular bead 40 is to engage the pilfer-proof band therewith when the cap is twisted to be opened. In order to enhance such function, a shape of an upper portion and a lower portion of the annular bead 40 are differed from each other. Specifically, the upper portion of the annular bead 40 is tapered in such a manner that an outer diameter increases gradually from the lower end of the thread 8 toward a portion at which the outer diameter is largest. An annular groove 41 is formed below the portion at which the outer diameter is largest so that the lower portion of the annular bead 40 is tapered in such a manner that the outer diameter decreases gradually from the portion at which the outer diameter is largest toward a bottom of the annular groove 41 at which the outer diameter is smallest. A taper angle of the lower portion of the annular bead 40 is larger than a taper angle of the upper portion of the annular bead 40. Thus, the stepped portion 11 is formed of the annular bead 40 and the annular groove 41.

As described, the annular bead 40 and the annular groove 41 that is, the stepped portion 11 is formed by rotating the cylindrical neck portion 25*a* together with the above-mentioned tool or roll around the center axis of the cylindrical neck portion 25*a*, thereby forming the stepped portion 11 on the diametrically-smaller cylindrical portion 25 or the cylindrical neck portion 25*a* in accordance with a shape of the forming surface of the tool or roll. For this reason, the diametrically-smaller cylindrical portion 25 or the cylindrical neck portion 25*a* is shaped to have a substantially true circular shape. A shape of the diametrically smaller cylindrical portion 25 at the completion of the beading step is shown in FIG. 10C.

The bottle-shaped can 1 and the manufacturing method thereof according to the exemplary embodiment is characterized by a shape of the incomplete thread portion of the thread 8. As described, the thread 8 formed on the neck portion 4 is a thread ridge. In order to engage the thread 8 smoothly with the thread groove formed on the cap, an upper incomplete thread portion 8*a* is formed at a starting end of the thread 8 of the curled portion 7 side, and a lower incomplete thread portion 8*b* is formed at a terminal end of the thread 8 of the stepped portion 11 side. In both of the incomplete thread portion 8*a* and 8*b*, a height or depth of the thread ridge (as will be called only the "height" hereinafter) is shorter than an average height h of the thread 8, and the height of the thread ridge gradually increases toward the average height h or gradually decreases from the average height h. That is, an effective thread portion 8*c* in which a height of the thread ridge is substantially the average height h is formed between the upper incomplete thread portion 8*a* and the lower incomplete thread portion 8*b*. According to the exemplary embodiment of the present disclosure, specifically, more than 1.9 laps but less than 2.1 laps of the effective thread portion 8*c* as a helical ridge is formed from the upper incomplete thread portion 8*a* to the lower incomplete thread portion 8*b*.

Specifically, a few laps of the thread 8 is formed on the diametrically-smaller cylindrical portion 25, and the upper incomplete thread portion 8*a* and the lower incomplete thread portion 8*b* are formed at both ends of the thread 8. According to the exemplary embodiment of the present disclosure, the upper incomplete thread portion 8*a* and the lower incomplete thread portion 8*b* may be formed without causing a local distortion the thread 8. The upper incomplete thread portion 8*a* is formed on the diametrically shrinking curved portion 25*d* at least partially. As described, the diametrically shrinking curved portion 25*d* is curved in both circumferential and axial directions to enhance rigidity of the diametrically shrinking curved portion 25*d*. Since the upper incomplete thread portion 8*a* is formed on the diametrically shrinking curved portion 25*d* at which the rigidity thereof is thus enhanced, the distortion resulting from forming the upper incomplete thread portion 8*a* may be reduced. For example, as a result of forming the thread 8, a flatness of the upper edge of the curled portion 7 may be changed by drawing the metallic material in the axial direction of the diametrically-smaller cylindrical portion 25. In addition, the diametrically-smaller cylindrical portion 25 or the neck portion 4 may be deformed to have an oval cross-section. Such distortions may be reduced by forming the upper incomplete thread portion 8*a* on the diametrically shrinking curved portion 25*d* compared to a case of forming the upper incomplete thread portion 8*a* on the cylindrical threaded portion 25*c*.

On the other hand, the lower incomplete thread portion 8*b* is formed on the diametrically shrinking portion 25*b* at least partially. As described, the diametrically shrinking portion 25*b* is also curved in both circumferential and axial directions to enhance rigidity of the diametrically shrinking portion 25*b*. Since the lower incomplete thread portion 8*b* is formed on the diametrically shrinking portion 25*b* at which the rigidity thereof is thus enhanced, the distortion resulting from forming the lower incomplete thread portion 8*b* may be reduced. As also described, as a result of forming the thread 8, the diametrically-smaller cylindrical portion 25 or the neck portion 4 may be deformed to have an oval cross-section by drawing the metallic material in the axial direction of the diametrically-smaller cylindrical portion 25. Such distortions may be reduced by forming the upper incomplete thread portion 8*a* on the diametrically shrinking curved portion 25*d* compared to the case of forming the upper incomplete thread portion 8*a* on the cylindrical threaded portion 25*c*.

A length of each of the upper incomplete thread portion 8*a* and the lower incomplete thread portion 8*b* in the circumferential direction is set in such a manner that the metallic material is drawn from a broad region. As shown in FIG. 11, a length of the upper incomplete thread portion 8*a* is defined by an angle θa (i.e., a central angle) between: a line drawn between a point at which a height of the thread ridge is one-half (½) of the average height h and a center point O of the diametrically-smaller cylindrical portion 25 (or the neck portion 4); and a line drawn between a point at which a height of the thread ridge is one-quarter (¼) of the average height h and a center point O of the diametrically-smaller cylindrical portion 25 (or the neck portion 4). Likewise, a length of the lower incomplete thread portion 8*b* is defined and expressed by an angle θb (i.e., a central angle) between: a line drawn between a point at which a height of the thread ridge is one-half (½) of the average height h and a center point O of the diametrically-smaller cylindrical portion 25 (or the neck portion 4); and a line drawn between a point at which a height of the thread ridge is one-quarter (¼) of the average height h and a center point O of the diametrically-smaller cylindrical portion 25 (or the neck portion 4). According to the exemplary embodiment, a length of the upper incomplete thread portion 8*a* is set in such a manner that the central angle θa falls within a range from 20 degrees to 60 degrees. On the other hand, a length of the lower incomplete thread portion 8*b* is set in such a manner that the central angle θb falls within a range from 10 degrees to 40 degrees.

Figure 12:
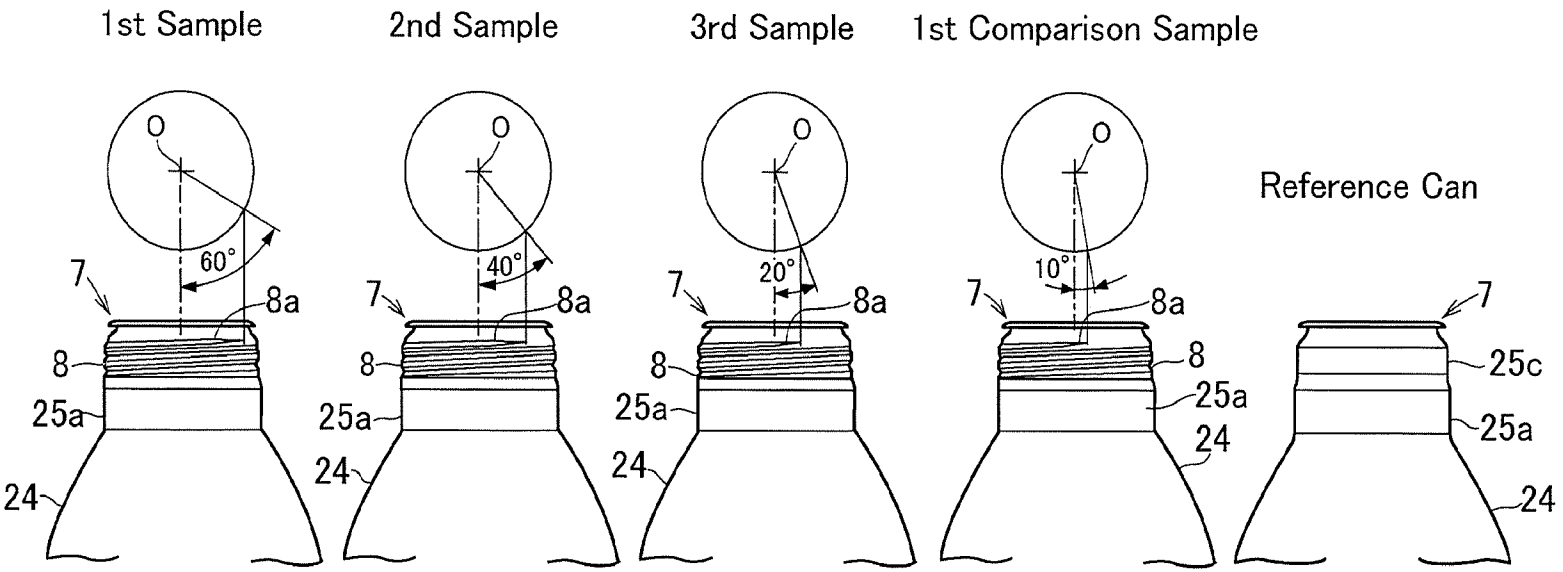
FIG. 12 shows shapes of the diametrically-smaller cylindrical portions in first to third sample cans, a first comparison sample can, and a reference can.

FIG. 12 shows sample cans having different lengths of the upper incomplete thread portion 8*a* prepared using forming tools of different shapes, and a reference can in which the thread is not formed on the neck portion. Those sample cans and the reference can were prepared in the same condition except for the shape of the forming tool. In the first sample can, a length of the upper incomplete thread portion 8*a* was adjusted to have the central angle θa of 60 degrees. In the second sample can, a length of the upper incomplete thread portion 8*a* was adjusted to have the central angle θa of 40 degrees. In the third sample can, a length of the upper incomplete thread portion 8*a* was adjusted to have the central angle θa of 20 degrees. In the first comparison sample can, a length of the upper incomplete thread portion 8*a* was adjusted to have the central angle θa of 10 degrees. In each of the first sample can, the second sample can, the third sample can, and the first comparison sample can, two laps of the thread 8 was formed respectively on the neck portion 4, and a length of the lower incomplete thread portion 8*b* was adjusted respectively to have the central angle θb of 20 degrees.

Figure 13:
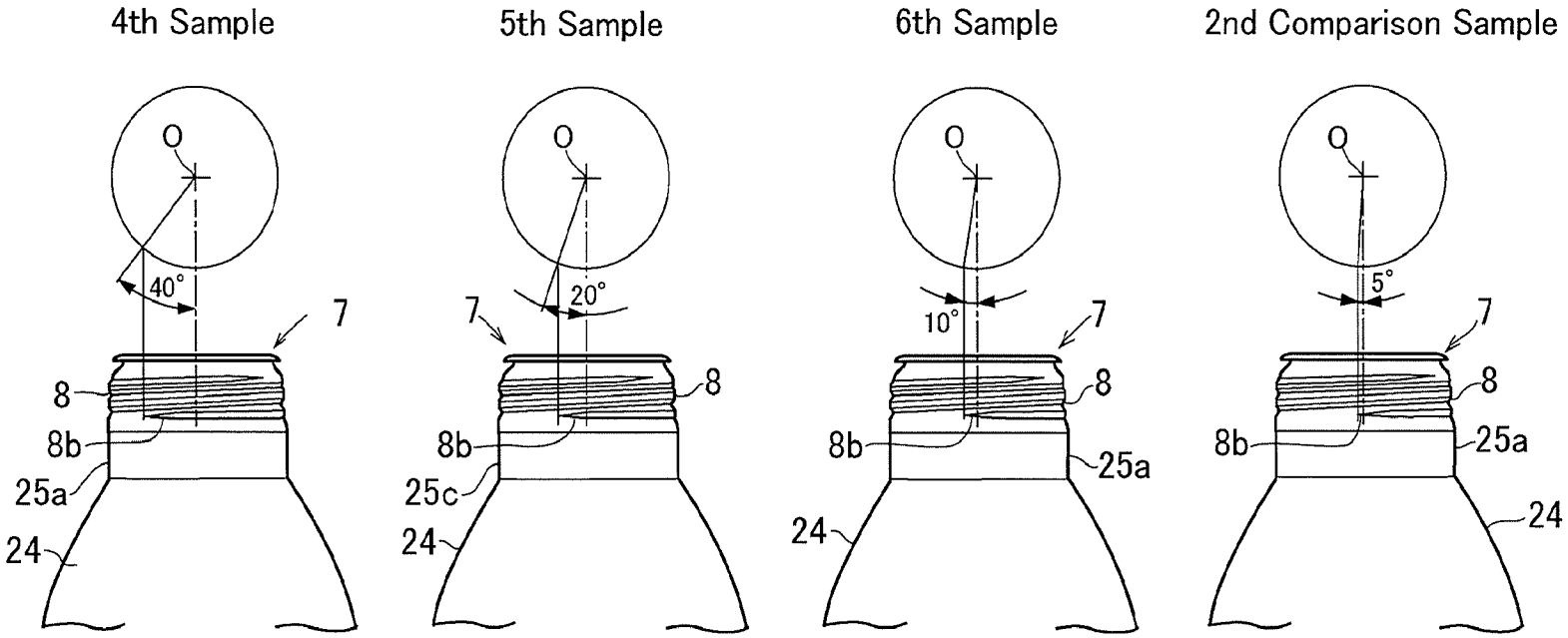
FIG. 13 shows shapes of the diametrically-smaller cylindrical portions in fourth to sixth sample cans, and a second comparison sample can.

In FIG. 13 shows sample cans having different lengths of the lower incomplete thread portion 8*b* prepared using forming tools of different shapes. Those sample cans were also prepared in the same condition except for the shape of the forming tool. In the fourth sample can, the length of the lower incomplete thread portion 8*b* was adjusted to have the central angle θb of 40 degrees. In the fifth sample can, a length of the lower incomplete thread portion 8*b* was adjusted to have the central angle θb of 20 degrees. In the sixth sample can, a length of the lower incomplete thread portion 8*b* was adjusted to have the central angle θb of 10 degrees. In the second comparison sample can, a length of the lower incomplete thread portion 8*b* was adjusted to have the central angle θb of 5 degrees. In each of the fourth sample can, the fifth sample can, the sixth sample can, and the second comparison sample can, two laps of the thread 8 was also formed respectively on the neck portion 4, and a length of the upper incomplete thread portion 8*a* was adjusted respectively to have the central angle θa of 40 degrees.

Figure 14:
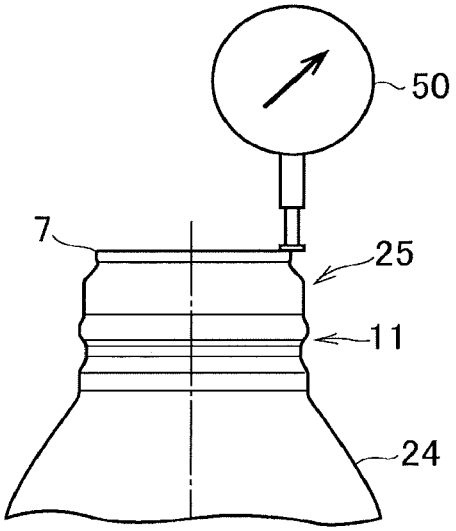
FIG. 14 is an explanatory view showing how to measure a flatness of the curled portion using a dial gauge.
Figure 15A:
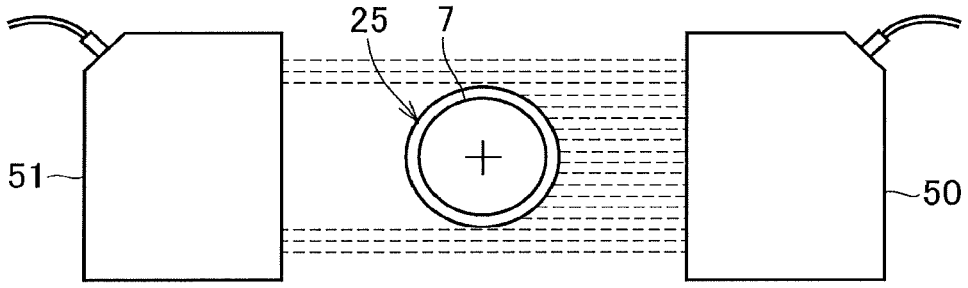
FIGS. 15A and 15B are explanatory views showing how to measure a circularity of the neck portion and the curled portion.
Figure 15B:
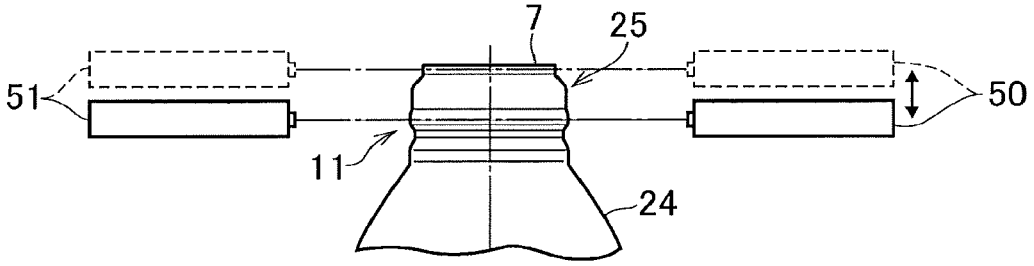

The final curling step and the bead forming step were applied to those sample cans to finish the neck portion 4, and thereafter a flatness of the curled portion 7 and a circularity of the neck portion 4 in the sample cans were measured. Likewise, a flatness of the curled portion 7 and a circularity of the diametrically-smaller cylindrical portion 25 in the reference can as an intermediate product after the third curling step were also measured. In order to calculate the flatness of the curled portion 7, as shown in FIG. 14, a level of the curled portion 7 with respect to a dial gauge 50 brought into contact to the upper edge of the curled portion 7 was measured all around the curled portion 7. Then, the flatness of the curled portion 7 was calculated by calculating a difference (max-min) between a maximum value (max) and a minimum value (min) of the measured level of the curled portion 7. In order to measure the circularity of the curled portion 7 and the stepped portion 11, the neck portion 4 or the diametrically-smaller cylindrical portion 25 of the sample can was disposed between a laser projector 51 and a laser receiver 52 as illustrated in FIG. 15A, and each width where the laser light was blocked by the curled portion 7 and the stepped portion 11 as illustrated in FIG. 15B was employed respectively as a diameter of each of the curled portion 7 and the stepped portion 1. Then, a diameter of the curled portion 7 was measured e.g., at sixteen points (or eight points) at regular intervals around a circumference of the curled portion 7. Thereafter, the circularity of the curled portion 7 was obtained by calculating a difference (max-min) between a maximum value (max) and a minimum value (min) of the measured diameters of the curled portion 7. The circularity of the stepped portion 11 was also calculated by the same procedures as the curled portion 7.

Measurement results of the circularity and flatness of the curled portion 7 are shown in FIG. 16. The circularity of the curled portion 7 may affect the torque to rotate the cap, therefore, a target value (or reference value) of the circularity of the curled portion 7 was set to 0.15. On the other hand, a reduction in the flatness of the curled portion 7 may cause a slow-leak to allow the gas contained in the can to leak slowly from the can and to allow the external gas to intrude slowly into the can. Therefore, a target value (or reference value) of the flatness of the curled portion 7 was set to 0.1. As can be seen from FIG. 16, in the first comparison sample can, not only the circularity but also the flatness of the curled portion 7 exceeds the reference values. Thus, the circularity and the flatness of the curled portion 7 in the first comparison sample can were unacceptable. By contrast, both circularity and flatness of the curled portion 7 fall below the reference values in all of the first to third sample cans. Thus, the circularity and the flatness of the curled portions 7 in all of the first to third sample cans were acceptable. According to the exemplary embodiment of the present disclosure, therefore, a length of the upper incomplete thread portion 8*a* is set in such a manner that the above-mentioned central angle falls within the range from 20 degrees to 60 degrees. If the length of the upper incomplete thread portion 8*a* is too long so that above-mentioned central angle is wider than 60 degrees, the upper incomplete thread portion 8*a* may interfere with the curled portion 7.

A cause of such difference in the circularity and flatness of the curled portions of the first to third sample cans and the first comparison sample can will be discussed hereinafter. The first to third sample cans and the first comparison sample can are formed by executing the final curling step and the bead forming step after the threading step. Consequently, the circularity and flatness of the curled portion 7 may be corrected by the final curling step to some extent, and the circularity of the curled portion 7 may be corrected to some extent again by the bead forming step. However, such correction function is exerted merely incidental as a result of executing the final curling step and the bead forming step, and therefore the circularity and flatness of the curled portion 7 may not be corrected completely. Nonetheless, in the first to third sample cans, the length of the upper incomplete thread portion 8*a* is relatively longer. Therefore, when forming the upper incomplete thread portion 8*a* in the first to third sample cans, the metallic material may be drawn from a broader region. As a result, distortion and deformation of the curled portion 7 resulting from forming the upper incomplete thread portion 8*a* may be reduced, and the distortion and deformation of the curled portion 7 may be corrected by the final curling step so that the circularity and flatness of the curled portion 7 fall below the reference values. By contrast, in the first comparison sample can, the length of the upper incomplete thread portion 8*a* is relatively shorter. Therefore, when forming the upper incomplete thread portion 8*a* in the first comparison sample can, the metallic material may be drawn locally from a smaller region. For this reason, although distortion and deformation of the curled portion 7 resulting from forming the upper incomplete thread portion 8*a* are reduced to some extent by the final curling step, the circularity and flatness of the curled portion 7 may not fall below the reference values.

Measurement results of the circularity and flatness of the stepped portion 11 are shown in FIG. 17. A target value (or reference value) of the circularity of the stepped portion 11 was also set to 0.15, and a target value (or reference value) of the flatness of the stepped portion 11 was also set to 0.1. As can be seen from FIG. 17, in the second comparison sample can, the circularity of the stepped portion 11 exceeds the reference value and hence the circularity of the stepped portion 11 in the second comparison sample can was unacceptable. By contrast, both circularity and flatness of the stepped portion 11 fall below the reference values in all of the fourth to sixth sample cans. Thus, the circularity and the flatness of the stepped portions 11 in all of the fourth to sixth sample cans were acceptable. Here, in the second comparison sample can, the flatness falls below the reference value. This is because the metallic material may not be drawn in the axial direction of the neck portion 4 from the upper edge of the curled portion 7 when forming the lower incomplete thread portion 8*b*. According to the exemplary embodiment of the present disclosure, therefore, a length of the lower incomplete thread portion 8*b* is set in such a manner that the above-mentioned central angle falls within the range from 10 degrees to 40 degrees. If the lower incomplete thread portion 8*b* extends to the stepped portion 11 or the annular bead 40 so that above-mentioned central angle is wider than 40 degrees, the lower incomplete thread portion 8*b* may interfere with the pilfer-proof band engaged with the stepped portion 11 or the annular bead 40.

Thus, in the bottle-shaped can 1 formed by the manufacturing method according to the exemplary embodiment of the present disclosure, the flatness of the upper edge of the neck portion 4 as a difference in a level thereof is less than 0.1 mm, and the circularity of the neck portion as a difference in a diameter thereof is less than 0.15 mm.

A cause of such difference in the circularity of the stepped portions of the fourth to sixth sample cans and the second comparison sample can will be discussed hereinafter. In the fourth to sixth sample cans, the length of the lower incomplete thread portion 8*b* is relatively longer, and in the second comparison sample can, the length of the lower incomplete thread portion 8*b* is relatively shorter. Therefore, distortion and deformation of the stepped portion 11 resulting from forming the lower incomplete thread portion 8*b* are smaller in the fourth to sixth sample cans, but greater in the second comparison sample can. For this reason, in the fourth to sixth sample cans, although the correction function of the bead forming step is incidental, the circularity of the stepped portion 11 may fall below the reference value. By contrast, in the second comparison sample can, distortion and deformation of the stepped portion 11 is significantly greater than the reference value, and hence the circularity may not be collected to fall below the reference value.

Figure 18:
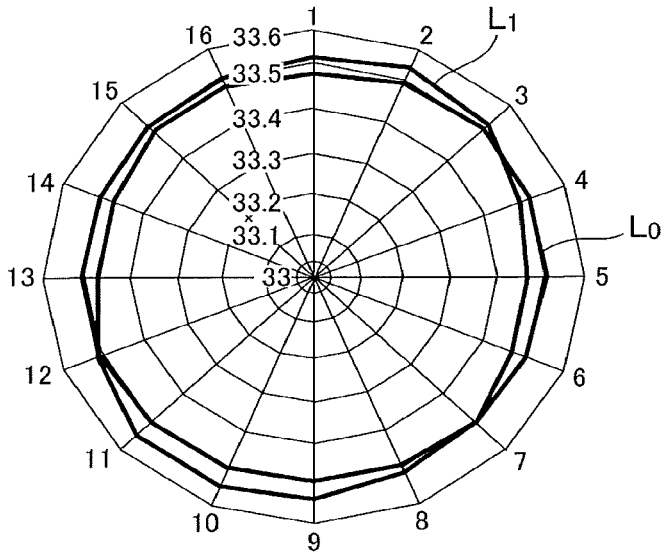
FIG. 18 is a circular chart showing radii of the neck portion measured at sixteen points.

In order to measure the circularity of the neck portion 4, an external diameter of the neck portion 4 of each of the sample cans and comparison sample cans was respectively measured at the sixteen points, and measurement results are indicated in the circular chart shown in FIG. 18. In FIG. 18, the line L0 indicates a measurement result of the reference can, and the line L1 indicates a measurement result of the first sample can or the second sample can. As indicated in FIG. 18, the measured value of the diameter of the neck portion 4 is large in a predetermined diametrical direction, and small in a direction perpendicular to the predetermined diametrical direction. That is, as a result of reduction in the circularity, the neck portion 4 is deformed into an oval shape. However, according to the exemplarily embodiment of the present disclosure, not only the circularity of the curled portion 7 but also the circularity of the stepped portion 11 fall below the reference values. According to the exemplarily embodiment of the present disclosure, therefore, the neck portion 4 can be prevented from being deformed into an oval shape. For this reason, an opening torque to dismount the cap from the neck portion 4 or a re-capping torque to mount the cap onto the neck portion 4 will not be increased excessively.

Here will be explained a positional relation between the upper incomplete thread portion 8*a* and the lower incomplete thread portion 8*b*. A distance between: the point at which a height of the thread ridge of the upper incomplete thread portion 8*a* is one-quarter (¼) of the average height h (i.e., the end point of the upper incomplete thread portion 8*a*); and the point at which a height of the thread ridge of the lower incomplete thread portion 8*b* is one-quarter (¼) of the average height h (i.e., the end point of the lower incomplete thread portion 8*b*), which is measured in a direction in which the thread ridge is getting higher in the circumferential direction, is set in such a manner that a central angle θc falls within a range from 60 degrees to 130 degrees. That is, the upper incomplete thread portion 8*a* and the lower incomplete thread portion 8*b* as the cause of the deformation or distortion are not concentrated within a predetermined angle range in the circumferential direction of the neck portion 4. For this reason, the metallic material will not be drawn only within a narrow angle range when forming the upper incomplete thread portion 8*a* and the lower incomplete thread portion 8*b*, and hence the neck portion 4 will not be deformed or distorted significantly. That is, if the central angle θc is wider than 60 degrees, the circularity of the neck portion 4 may be corrected to fall below the reference value by the final curing step and the bead forming step, even if the neck portion 4 has been deformed slightly into an oval shape as a result of forming the upper incomplete thread portion 8*a* and the lower incomplete thread portion 8*b*. Here, if the central angle θc is wider than 130 degrees, a length of the thread 8 would be too long. According to the exemplarily embodiment of the present disclosure, therefore, an upper limit of the central angle θc is set to 130 degrees.

Thus, according to the exemplarily embodiment of the present disclosure, a length of the incomplete thread portion is defined between the point at which a height of the thread ridge is one-half (½) of the average height h and the point at which a height of the thread ridge is one-quarter (¼) of the average height h. Accordingly, an actual length of the incomplete thread portion in which a height of the thread ridge is lower than the average height h may be longer than the definition of the present disclosure. However, if the incomplete thread portion contains such portion in which the height of the thread ridge is one-quarter to one-half of the average height as defined in the present disclosure, the bottle-shaped can having such thread is included in the scope of the present disclosure.

Although the above exemplary embodiments of the present disclosure have been described, it will be understood by those skilled in the art that the present disclosure should not be limited to the described exemplary embodiments, and various changes and modifications can be made within the scope of the present disclosure.

What is claimed is:

1. A metallic threaded bottle-shaped can, comprising:

a cylindrical trunk portion;

a shoulder portion that is formed continuously upwardly from an upper end of the trunk portion in such a manner that an outer diameter is gradually reduced toward an upper side;

a cylindrical neck portion having an opening on an upper end, that is formed continuously upwardly from an upper central end of the shoulder portion; and a thread as a helical ridge that is formed around the neck portion, wherein the thread includes an upper incomplete thread portion that is formed at an upper end of the thread, a height of the ridge of the upper incomplete thread portion is shorter than an average value of the entire thread, and increases gradually toward the average value, and a length of the upper incomplete thread portion in a circumferential direction of the neck portion between: a first point at which a height of the ridge is one-half of the average value; and a second point at which a height of the ridge is one-quarter of the average value, is set in such a manner that an angle between a line drawn between the first point and a center point of the neck portion, and a line drawn between the second point and the center point of the neck portion falls within a range from 20 degrees to 60 degrees.

2. The metallic threaded bottle-shaped can as claimed in claim 1, wherein the thread includes a lower incomplete thread portion that is formed at a lower end of the thread, a height of the ridge of the lower incomplete thread portion is shorter than the average value of the entire thread, and decreases gradually from the average value, and a length of the lower incomplete thread portion in the circumferential direction of the neck portion between: a third point at which a height of the ridge is one-half of the average value; and a fourth point at which a height of the ridge is one-quarter of the average value, is set in such a manner that an angle between a line drawn between the third point and the center point of the neck portion, and a line drawn between the fourth point and the center point of the neck portion falls within a range from 10 degrees to 40 degrees.

3. The metallic threaded bottle-shaped can as claimed in claim 2, wherein more than 1.9 laps but less than 2.1 laps of an effective thread portion in which a height of the ridge is the average value is formed between the upper incomplete thread portion and the lower incomplete thread portion, and a distance between the second point and the fourth point is set in such a manner that an angle between the line drawn between the second point and the center point of the neck portion, and the line drawn between the fourth point and the center point of the neck portion falls within a range from 60 degrees to 130 degrees.

4. The metallic threaded bottle-shaped can as claimed in claim 1, wherein the neck portion comprises a first cylindrical portion on which the thread is formed, and a diametrically shrinking curved portion formed between an upper end of the first cylindrical portion and a tapered portion in which an outer diameter decreases gradually upwardly, an effective thread portion in which a height of the ridge is the average value is formed on the first cylindrical portion, and the upper incomplete thread portion is funned on the diametrically shrinking curved portion.

5. The metallic threaded bottle-shaped can as claimed in claim 2, wherein the neck portion comprises a second cylindrical portion firmed continuously from an upper end of the shoulder portion, a diametrically shrinking portion formed continuously from the second cylindrical portion in which a diameter thereof is reduced gradually toward the upper side, and a first cylindrical portion formed continuously from an upper end of the diametrically shrinking portion on which the thread is formed, an effective thread portion in which a height of the ridge is the average value is formed on the first cylindrical portion, and the lower incomplete thread portion is formed on the diametrically shrinking portion.

* * * * *